US006314257B1

(12) United States Patent
Ishii et al.

(10) Patent No.: US 6,314,257 B1
(45) Date of Patent: Nov. 6, 2001

(54) SIMULTANEOUS DEVELOPING/CLEANING DEVICE

(75) Inventors: Yasuyuki Ishii, Mishima; Shinji Uehara, Susono; Tomomi Kakeshita, Mishima, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/515,669

(22) Filed: Feb. 29, 2000

(30) Foreign Application Priority Data

Mar. 2, 1999 (JP) ..... 11-054018
Nov. 12, 1999 (JP) ..... 11-322325

(51) Int. Cl.[7] ..... G03G 15/24
(52) U.S. Cl. ..... 399/150
(58) Field of Search ..... 399/281, 284, 399/285, 279, 149, 150

(56) References Cited

U.S. PATENT DOCUMENTS 4,743,937 * 5/1988 Martin ..... 399/281
4,764,841 * 8/1988 Brewington et al. ..... 399/284
5,168,312 * 12/1992 Aoto et al. ..... 399/284
5,592,266 * 1/1997 Park et al. ..... 399/284
5,628,043 * 5/1997 Ikeda et al. ..... 399/281
5,887,233 * 3/1999 Abe et al. ..... 399/284

* cited by examiner

*Primary Examiner*—Robert Beatty
(74) *Attorney, Agent, or Firm*—Fitzpatrick, Cella, Harper & Scinto

(57) ABSTRACT

A simultaneous developing/cleaning device includes a developer carrying member for carrying a layer of developer, the developer carrying member forming a developing zone where the layer of the developer is contacted to the developer carrying member and to an image bearing member carrying a latent image; and a charge application member for applying electric charge to the developer carried on the developer carrying member by electric discharge, the charge application member being provided upstream of the developing zone with respect to a moving direction of the developer carrying member.

6 Claims, 8 Drawing Sheets

SIMULTANEOUS DEVELOPING/CLEANING DEVICE

FIELD OF THE INVENTION AND RELATED ART

The present invention relates to a developing apparatus which develops an electrostatic latent image formed on an image bearing member such as an electrophotographic photosensitive member or an electrostatically recordable dielectric member, into a visible image with the use of developer (toner). It also relates to an image forming apparatus.

An electrophotographic method is a method for obtaining a copy. According to this method, in order to obtain a copy, an electrical latent image (electrostatic latent image) is formed on a photosensitive member through various image formation processes; the latent image is developed into a visible image with the use of toner; the visible image, or the toner image, is transferred onto a piece of transfer medium; and the transferred image is fixed to the piece of transfer medium with the use of heat and/or pressure.

With the current strong demand for a developing apparatus which is superior in resolution, clarity, and the like, it is imperative to develop a superior method for forming a thin layer of toner on the developer bearing member (developer conveying member) of a developing apparatus, and an apparatus for carrying out such a method. Thus, a number of methods have been proposed to answer such demand.

One of such methods, which has been developed recently, is a "nonmagnetic, single component, DC developing method", according to which a latent image is developed with the use of a semiconductive development roller, or a development roller with a dielectric surface layer, as a developer bearing member. More specifically, a semiconductive development roller, or a development roller with a dielectric surface layer, which is coated with developer, is placed virtually in contact with the surface layer of a photosensitive member, with the interposition of developer between the peripheral surfaces of the development roller and photosensitive member.

FIG. 10 is a schematic sectional view of an example of a nonmagnetic, single component, DC developing apparatus, and depicts the general structure thereof.

A referential character 1 designates a photosensitive drum as an image bearing member. This photosensitive drum 1 is rotationally driven at a predetermined peripheral velocity in the clockwise direction indicated by an arrow mark A, and an electrostatic latent image is formed on the peripheral surface of the photosensitive drum 1 with the use of unillustrated means for carrying out image formation processes.

A referential character 4 designates a nonmagnetic, single component, DC developing apparatus. A referential character 4*a* designates a developing means housing portion, and referential characters 4*b*, 4*c*, and 4*d* designate a development roller as a developer bearing member, an elastic roller as a developer supplying member for supplying the development roller with developer, and an elastic blade as a developer layer regulating member, correspondingly, which all are housed in the developing means housing portion 4*a*. A referential character t stands for nonmagnetic toner as single component developer held in the developing means housing portion 4*a*.

The development roller 4*b* is placed virtually in contact with the photosensitive drum 1 with the interposition of the developer between the two components, and is rotationally driven in the counterclockwise direction indicated by an arrow mark B. A referential character b stands for a development station, that is, the location in which the development roller 4*b* virtually makes contact with the photosensitive drum 1, with the interposition of the developer between the two.

The elastic roller 4*c* is placed in contact with the development roller 4*b*, with the presence of a predetermined amount of contact pressure, and is rotationally driven in the counterclockwise direction indicated by an arrow mark D.

The elastic blade 4*d* is placed in contact with the development roller 4*b*, on the downstream side of the location in which the development roller 4*b* is placed in contact with the elastic roller 4*c*, in terms of the rotational direction of the development roller 4*b*.

A referential character combination S2 designates a development bias application electrical power source for applying DC voltage (bias) to the development roller 4*b*.

The elastic roller 4*c* serves as a roller for supplying the development roller 4*b* with the toner t. After being supplied to the peripheral surface of the development roller 4*b*, the toner is conveyed further as the development roller 4*b* is rotated, and is triboelectrically charged, while being formed into a thin layer, in the contact area between the elastic blade 4*d* and development roller 4*b*. As the development roller 4*b* is further rotated, the thin layer of toner on the development roller 4*b* is conveyed to the development station b, in which the thin layer of toner is used to develop the electrostatic latent image on the photosensitive drum 1. The toner which remains on the development roller 4*b* without being used for the development of the electrostatic latent image on the photosensitive drum 1, in the development station b, is conveyed back into the development means housing portion 4*a* by the rotation of the development roller 4*b*, and is stripped away from the peripheral surface of the development roller 4*b*, in the contact area between the development roller 4*b* and elastic roller 4*c*. The portion of the development roller 4*b*, from which the residual toner has been stripped away, is provided with a fresh supply of toner t by the elastic roller 4*c*. This functional cycle, or operational, cycle is repeated.

However, the above described nonmagnetic, single component, DC developing method suffered from the following problems. That is, the repetition of the image forming process accelerated toner deterioration, which increased the amount of the toner, the polarity of which was opposite to the normal toner polarity. This toner with the wrong polarity transferred onto the areas of the photosensitive drum 1 correspondent to the background portions of the image (hereinafter, the effect created by this kind of toner will be referred to as "reversal fog"). Reversal fog does not easily transfer onto transfer medium, and therefore, its effect upon image quality is small. However, it increases the amount of wasteful toner consumption, reducing thereby the number of copies producible by a predetermined amount of toner initially held in the developing apparatus, and therefore, has a derogatory effect upon the effort to increase the length of the developing apparatus service life.

Referring to FIG. 11, in the case of a DC based contact development process, as long as the amount of the electrical charge held by the toner is within a proper range (−35 to −80 $\mu$C/g), control can be executed in such a manner that the height of the toner layer which forms a linear image, and the height of the toner layer which forms a solid image, become the same. The cause for the increase in the height of the linear image toner layer is thought to be that as development becomes possible on the downstream side (where there is a gap between the development roller and photosensitive drum) of the contact area between the development roller and photosensitive drum, the toner particles aggregate on the development roller 4*b*, as if broomed, increasing thereby the height of the linear image toner layer. However, as the amount of electrical charge held by the toner on the development roller 4*b* increases, the force with which the toner is held to the development roller also increases due to the reflective force. Therefore, it becomes possible to reproduce sharp lines and dots, that is, lines and dots which do not suffer from the effects of scattered toner particles. However, the decrease in the amount of electrical charge held by the toner on the development roller, which is caused by the toner deterioration, increases the height of the linear image toner layer, causing the toner particles to scatter, which in turns causes the lines and dots to appear smeared, reducing the image quality, in addition to inevitably increasing the amount of toner consumption.

SUMMARY OF THE INVENTION

The primary object of the present invention is to prevent the increase in the amount of the toner opposite in polarity to the normal toner.

Another object of the present invention is to decrease the amount of reversal fog so that the amount of toner consumption is decreased; the developing apparatus service life; the operational cost of a developing apparatus is reduced; and the amount of electrical charge held by toner is kept at an appropriate level to reproduce sharp lines and dots, that is, lines and dots which do not suffer from the smearing by scattered toner particles.

According to an aspect of the present invention, there is provided a developing device comprising: a developer carrying member for carrying a layer of developer, said developer carrying member forming a developing zone where the layer of the developer is contacted to said developer carrying member and to an image bearing member carrying a latent image; and a charge application member for applying electric charge to the developer carried on said developer carrying member by electric discharge, said charge application member being provided upstream of said developing zone with respect to a moving direction of said developer carrying member.

According to another aspect of the present invention, there is provided an image forming apparatus, comprising an image bearing member for bearing a latent image; a developer carrying member for carrying a layer of a developer, said developer carrying member forming a developing tone where said developer carrying member is contacted to the layer of the developer which is contacted to an image bearing member carrying a latent image; and a charge application member for applying electric charge to the developer carried on said developer carrying member by electric discharge, said charge application member being provided upstream of said developing zone with respect to a moving direction of said developer carrying member.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Embodiment 1 (FIGS. 1–6)

Figure 1:
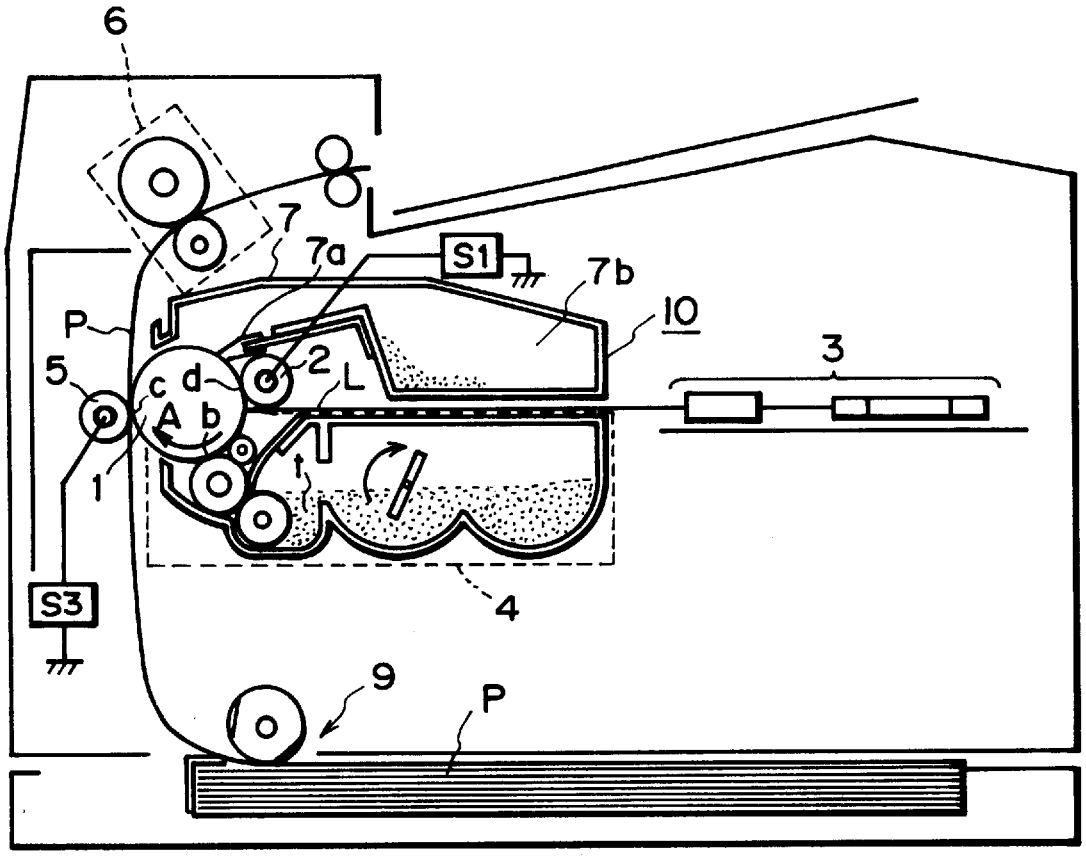
FIG. 1 is a schematic sectional view of the image forming apparatus in the first embodiment of the present invention, and depicts the general structure thereof.

FIG. 1 is a schematic sectional view of an example of an image forming apparatus in accordance with the present invention, and depicts the general structure thereof. The image forming apparatus in this embodiment is a laser printer, which employs an electrophotographic process, a transfer method, a reversal development process, and a process cartridge system.

A referential character 1 designates an electrophotographic photosensitive member (photosensitive drum) in the form of a rotational drum with a diameter of 30 mm, which is rotationally driven at a process speed of 1 rps (peripheral velocity of 94.2 mm/sec) in the clockwise direction indicated by an arrow mark A.

A referential character 2 designates a charge roller as a charging means. This charge roller 2 is an electrically conductive elastic roller, and is placed in contact with the photosensitive drum 1, with the application of a predetermined amount of pressure, forming a charging station a between itself and the photosensitive drum 1. In this embodiment, this charge roller 2 rotates by following the rotation of the photosensitive drum 1.

A referential character combination S1 designates an electrical power source for applying charge bias to the charge roller 2. In this embodiment, DC voltage, the level of which is higher than the voltage level at which electrical discharge begins in the nip between the charge roller 2 and photosensitive drum 1, is applied to the charge roller 2, across the portion in the nip, from the electrical power source S1. More specifically, a DC voltage of −1,300 V is applied as the charge bias, so that the peripheral surface of the photosensitive drum 1 is uniformly charge to a potential level of −700 V (dark area potential level).

A referential character 3 designates an exposing unit as a latent image forming means for writing an electrostatic latent image on the photosensitive drum 1. In this embodiment, the exposing unit 3 is a laser scanner, which outputs a laser beam L modulated with a sequential, digital electrical signals in accordance with image formation data, and scans the uniformly charged peripheral surface of the photosensitive drum 1. The power of the laser scanner is adjusted so that, as the entire area of the uniformly charged peripheral surface of the photosensitive drum 1 is exposed to the laser beam, the potential level of the entire area of the peripheral surface of the photosensitive drum becomes −150 V.

Thus, as the uniformly charge peripheral surface of the photosensitive drum 1 is exposed to the scanning laser beam L, the potential level of the exposed areas of the photosensitive drum 1 attenuate in accordance with the image formation data. As a result, an electrostatic latent image, that is, an image drawn by the electrostatic contrast between the dark area potential and light area potential, is formed on the peripheral surface of the photosensitive drum 1.

A referential character 4 designates a reversal type developing apparatus which employs a nonmagnetic, single component, contact type developing system. The electrostatic latent image formed on the peripheral surface of the photosensitive drum 1 is developed in reverse by negatively charged toner t (negative toner) as reversal developer, in the developing station b. In other words, negative toner is adhered to the image portions (exposed portions) of the electrostatic latent image. This developing apparatus 4 will be described in more detail in the following section, i.e., Section 2.

Designated by a referential character 5 is a transfer roller, which is an electrically conductive elastic roller, and is placed in contact with the photosensitive drum 1, with the application of a predetermined amount of pressure, forming a transfer station c between itself and the photosensitive drum 1. This transfer roller 5 rotates at approximately the same peripheral velocity as the photosensitive drum 1, following the rotation of the photosensitive drum 1. Thus, the rotational direction of the transfer roller 5 in the transfer station c is the same as that of the photosensitive drum 1.

A referential character combination S3 designates an electrical power source for applying transfer bias to the transfer roller 5. In this embodiment, positive transfer bias, that is, bias, the polarity of which is opposite to the polarity of the electrical potential of the toner t, which is negative, is applied to the transfer roller 5 from the transfer power source S3.

In the transfer station c, the toner image on the peripheral surface of the rotating photosensitive drum 1 is continuously transferred, starting from the leading end, onto a piece of transfer medium P, that is, recording medium, which is fed into the transfer station c, with proper timing, from a sheet feeding portion 9. Then, the recording medium P is conveyed further, being pinched between the photosensitive drum 1 and transfer roller 5. The application of the transfer bias to the transfer roller 5 is continued while the transfer medium P is passing through the transfer station c.

After coming out of the transfer station c, the transfer medium P is separated from the peripheral surface of the photosensitive drum 1, starting from the leading end, and introduced into a fixing apparatus 6, in which the toner image is fixed to the recording medium P. Then, the recording medium P is discharged as a copy.

The transfer residual toner, that is, the toner which remains on the peripheral surface of the photosensitive drum 1 without being transferred onto the transfer medium P in the transfer station c, is carried to a cleaning apparatus 7, by which it is scraped away from the peripheral surface of the photosensitive drum 1, more specifically, by the cleaning blade 7*a* of the cleaning apparatus 7, and is collected into a waste toner bin 7*b*. After the cleaning, the photosensitive drum 1 is repeatedly used for image formation.

The printer in this embodiment employs a process cartridge 10, which is removably installable in the main assembly of the printer, and in which four processing devices, which are the photosensitive drum 1, charge roller 2 as a contact type charging member, developing apparatus 4, and cleaning apparatus 7, are integrally disposed.

A process cartridge means a cartridge, which is removably installable in the main assembly of an image forming apparatus, and in which an image bearing member, and at least one processing device among a charging means, a developing means, and the like, are integrally disposed. A process cartridge system makes it possible to give an image forming apparatus a user-friendly, that is, easy-to-handle, structure.

(1) Developing Apparatus 4

Figure 2:
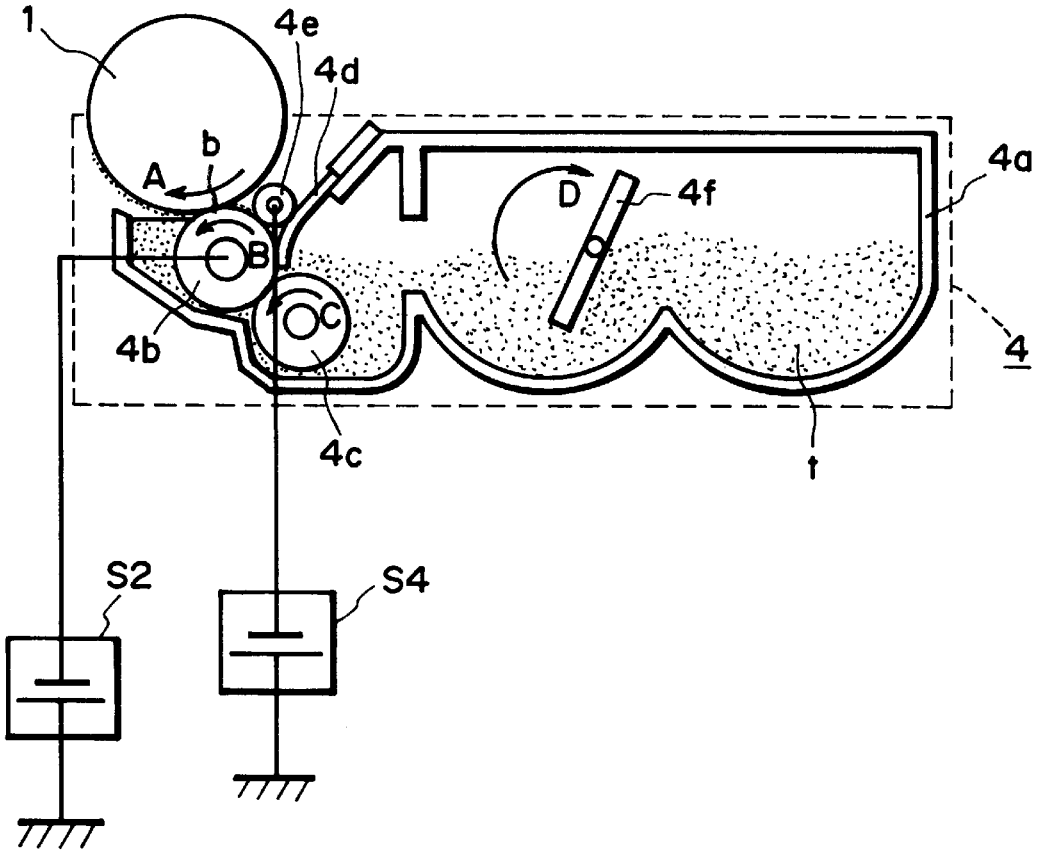
FIG. 2 is an enlarged sectional view of the developing apparatus portion of the image forming apparatus in FIG. 1.
Figure 10:
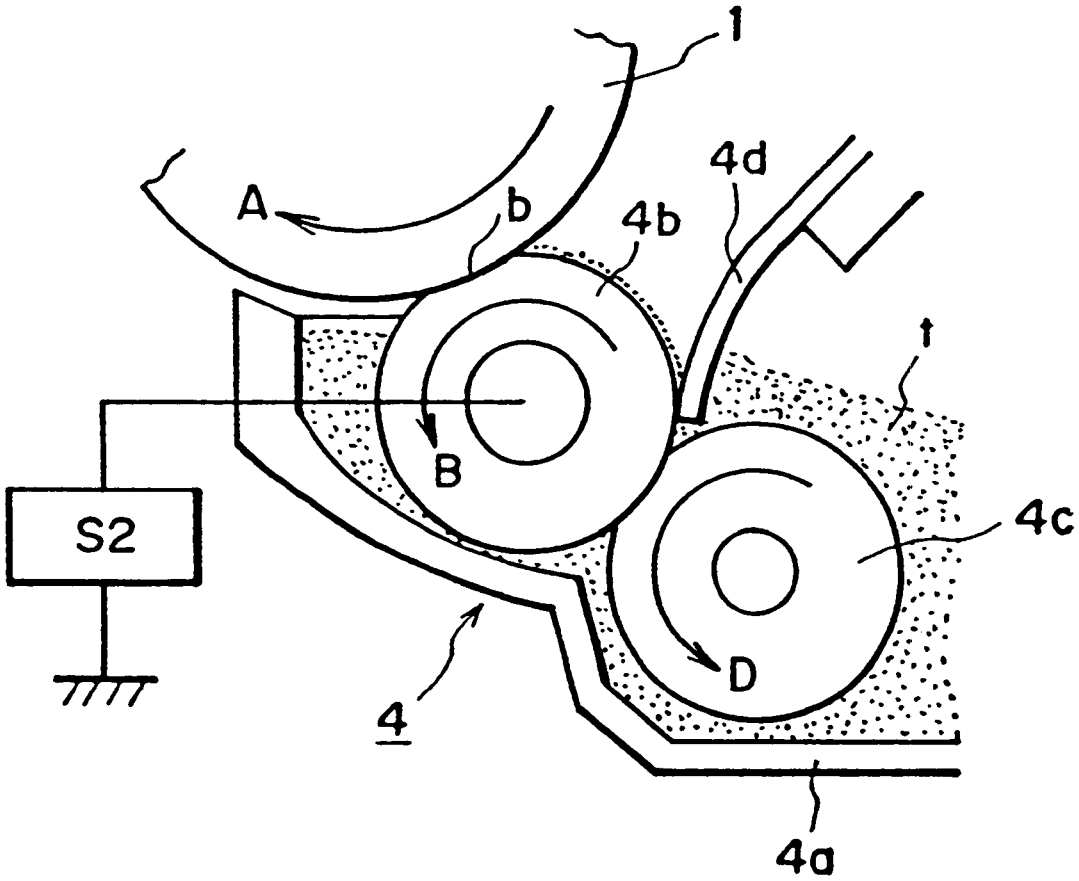
FIG. 10 PRIOR ART
FIG. 10 is a schematic sectional view of an example of a nonmagnetic, single component, DC based, contact type developing apparatus.
Figure 11:
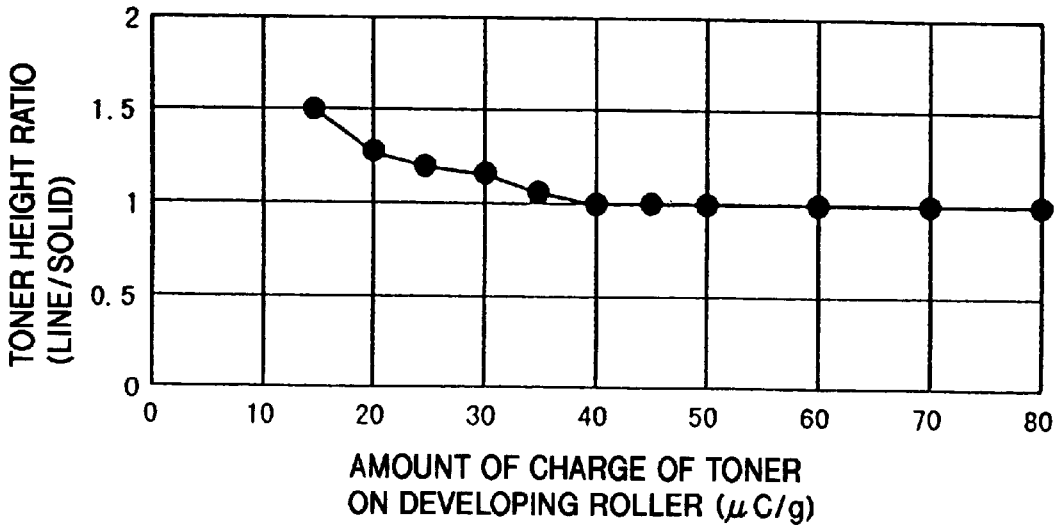
FIG. 11 PRIOR ART
FIG. 11 is a graph which shows the relationship between the amount of the electric charge which the toner on the development roller has, and the height of the toner layer which forms a linear or solid image.

FIG. 2 is an enlarged sectional view of the developing apparatus 4 (developing apparatus portion of an image forming apparatus). The structural members and portions in this 1 identical to those in the nonmagnetic, single component, contact type developing apparatus illustrated in FIG. 10 are designated with the same referential characters as those given to the structures and portions of the developing apparatus in FIG. 10.

a) Development Roller 4*b*

The development roller 4*b* as a developer bearing member (developer conveying member) is disposed in the developing means housing portion 4*a*, in parallel to the opening which extends in the longitudinal direction of the process cartridge, being placed virtually in contact with the photosensitive drum 1 through the opening, with the interposition of developer between them. It rotates in the counterclockwise direction indicated by the arrow mark B. The development roller 4*b* is disposed so that the approximately bottom half of the cylindrical surface of the development roller 4*b* remains in the developing means housing portion 4*a*, and the approximately top half of it is exposed above the developing means housing portion 4*a* through the opening. The development roller 4*b* is disposed in parallel to the photosensitive drum 1, in contact with the photosensitive drum 1, by a portion of the top half portion exposed from the developing means housing portion 4*a*.

The peripheral surface of the development roller 4*b* is provided with a proper degree of unevenness to increase the amount of friction between the peripheral surface of the development roller 4*b* and the toner t, and also to efficiently convey the toner t.

In this embodiment, the development roller 4*b* is 16 mm in diameter, and 240 mm in length, and comprises a 4 mm thick silicon rubber layer, and a layer of acrylic or urethane coated on the silicon rubber layer. It has an electrical resistance of $10^4$–$10^6\Omega$, a surface roughness Rz of 0.5–0.9 $\mu$m, and a hardness of 45° in Asker scale C (applied load of 9.8 N (1 kg). It is placed in contact with the photosensitive drum 1, with the application of a predetermined amount of pressure, so that the amount of the invasion of the development roller 4*b* into the photosensitive drum 1 becomes 70 $\mu$m, and is rotated at a peripheral velocity of 170 mm/sec, in contrast to the peripheral velocity of the photosensitive drum 1, which is 94.2 mm/sec.

The electrical resistance value is measured in the following manner. First, an aluminum roller with a diameter of 30 mm (plain aluminum cylinder) is placed in contact with the development roller 4*b* with the application of a load of 4.9 N, 500 gF) across the entirety of their lengths, and the aluminum roller is rotated at 0.5 rps. Then, a DC voltage of 400 V is applied to the development roller 4*b*. A resistor with a resistance value of 10 KΩ is connected to the ground side, and the voltage between the two terminals of the resistor is measured to calculate the amount of current through the resistor, from which the resistance value of the development roller 4*b* is calculated.

To the development roller 4*b*, a predetermined development DC voltage (bias) is applied from a development bias application power source S2.

b) Elastic Roller 4*c*

As for the structure of the elastic roller 4*c* which supplies the aforementioned development roller 4*b* with the toner t, in consideration of the fact that the elastic roller 4*c* must be enabled not only to supply the development roller 4*b* with toner, but also to strip the residual toner, that is, the toner which was not used for development in the development station b, the elastic roller 4*c* is desired to have a foamed, sponge-like, skeletal structure, or a fur brush-like structure created by planting fiber, for example, rayon fiber, nylon fiber, or the like, on the metallic core. In this embodiment, an elastic roller with a diameter of 16 mm, which comprises a metallic core, and a layer of polyurethane foam placed on the peripheral surface of the metallic core, is employed.

As for the width of the interface between the elastic roller 4*c* and development roller 4*b* in terms of the rotational direction of the elastic roller 4*c*, a width of 1–6 mm is effective. Further, it is desired that there is a difference in surface velocity between the elastic roller 4*c* and development roller 4*b*, in the interface between the two rollers. In this embodiment, the aforementioned width of the interface between the two rollers is set at 4 mm, and the elastic roller 4*c* is rotationally driven in the direction indicated by an arrow mark C, by an unillustrated driving means, with predetermined timing, so that the peripheral velocity of the elastic roller 4*c* becomes 80 mm/s during the developing operation.

c) Elastic Blade 4*d*

The elastic blade 4d as a developer layer thickness regulating member is supported by a blade supporting metallic plate, and is placed in contact with the peripheral surface of the development roller 4*b*, so that the surface of the portion of the elastic blade 4*d* adjacent to the free end of the elastic blade 4*d* makes contact with the peripheral surface of the development roller 4*b*, at a location which is on the upstream side of the developing station b in terms of the rotational direction of the development roller 4*b*, and is on the downstream side of the interface between the development roller 4*b* and elastic roller 4*c* in terms of the rotational direction of the development roller 4*b*.

As for the structure of the elastic blade 4*d*, the elastic blade 4*d* is a simple blade formed of silicon rubber, urethane rubber, or the like, or a member which comprises a springy base member, for example, a piece of thin metallic plate formed of SUS, or phosphor bronze, and a piece of rubber adhered to the springy base member, on the side which makes contact with the development roller 4*b*.

As for the direction in which the elastic blade 4*d* is extended to be placed in contact with the development roller 4*b*, it is the so-called counter direction, that is, the direction in which the free end of the elastic blade 4*d* is positioned on the upstream side of the base end of the elastic blade 4*d* in terms of the rotational direction of the development roller 4*b*.

In this embodiment, the elastic blade 4*d* comprises a 1.0 mm thick piece of urethane rubber, and a blade supporting metallic plate to which the urethane rubber piece is adhered. The amount of the pressure by which the elastic blade 4*d* is pressed upon the development roller 4*b* is set in a range of $2.45\times10^{-2}$–$3.34\times10^{-2}$ N/cm (25–35 g/cm). As for the method for measuring the linear load, first, three pieces of thin metallic plates, the frictional coefficients of which are known, are inserted between the elastic blade 4*d* and development roller 4*b*, and the pressure necessary to pull out the center metallic plate is measured with the use of a spring based scale. Then, the linear load is obtained by converting the value obtained by the scale into the linear load.

d) Toner t

As for the toner t, nonmagnetic, single component developer, the particles of which are spherical and have a smooth surface, is employed. This is because such toner is superior in transferability, and is high in lubricity, being advantageous in that it is small in the amount of wear which occurs to the photosensitive drum 1 when the residual toner, that is, the toner which remains on the photosensitive drum 1, without being transferred, is removed by the cleaning means 7, for example, a blade or a fur brush.

More specifically, the toner t with a volumetric resistivity of no less than $10^{14}\Omega$, a shape factor SF-1 of 100–180, and a shape factor SF-2 of 100–140, is used.

The volumetric resistivity of the toner is measured in the following manner. The measuring electrode side is 0.238 $cm^2$ (6 mm in diameter). A pressure of 980/$cm^2$ (96.1 kPa) is applied with the use of a weight of 1,500 g. The thickness of the layer of toner is in a range of 0.5–1.0 mm. The amount of current is measured with the use of a micro-current meter (YHP4140pA METER/DC voltage source), while applying a DC voltage of 400 V. The volumetric resistivity (specific resistance) is calculated from the electric resistance value.

The shape factors SF-1 and SF-2 are defined as the values obtained by the following formulas. More specifically, 100 toner images are randomly sampled with the used of Hitachi FE-SEM (S-800), and the obtained image data are introduced, for analysis, into an image analyzer (Luzex3: product of Nikore Co.) through an interface.

$$SF\text{-}1=(MXLNG)^2/AREA\times\pi/4\times100$$

$$SF\text{-}2=(PERl)^2/AREA\times\pi/4\times100$$

AREA: projected area of toner particle

MXLNG: absolute maximum length

ERl: circumference

Surface factor SF-1 represents degree of sphericity, and the greater the SF-1 of an object is relative to 100, the less spherical, or more undefined, the shape of the object is.

Surface factor SF-2 represents degree of unevenness of a surface, and the greater the SF-2 of an object is relative to 100, more uneven the surface of the object is.

As for a method for manufacturing the toner t, the so-called pulverization method may be employed, provided that it can keep the shape factors within the aforementioned range. There are other methods in addition to the pulverization method; for example, a method for directly producing toner with the use of the suspension polymerization method stated in Japanese Laid-Open Patent Application Nos. 10,231/1961 and 53,856/1984, a dispersion polymerization method for directly producing toner with the use of hydrous organic solvent in which monomer is soluble, but polymer is insoluble, and an emulsion polymerization method, for example, a soap-free polymerization method for directly producing toner with the presence of water soluble, polar, polymerization initiator.

In this embodiment, a suspension polymerization method, which makes it possible to keep the shape factors SF-1 and SF-2 of the toner within ranges of 100–180 and 100–140, respectively, and also makes it relatively easy to produce microscopic toner, the particle size of which is within a range of 4–8 $\mu$m, and the particle size distribution of which is relatively sharp, is used under the normal pressure or increased pressure, to produce a colored particle suspension from a combination of styrene and n-butyl acrylate, as monomer, metallic salicylate as charge controlling agent, saturated polyester as polar resin, and also coloring material.

Then, hydrophobic silica is added by 1.5 wt.% to the solution in which the colored particles are suspended, to obtain the aforementioned toner t, which is negative in polarity, is superior in transferability, and is much smaller in the amount of wear which occurs to the photosensitive drum 1 when the photosensitive drum 1 is cleaned.

e) Developer Charging Member 4*e* (Electrical Charge Giving Member) and Effects Thereof A referential character combination 4*e* designates a toner charging roller as a developer charging member. This toner charging roller 4*e* is placed in contact with the peripheral surface of the development roller 4*b*, with the interposition of the developer between the toner charging member 4*e* and development roller 4*b*, at a point which is on the upstream side of the developing station b in terms of the rotational direction of the developing roller 4*b*, and on the downstream side of the interface between the development roller 4*b* and elastic blade 4*d* in terms of the rotational direction of the development roller 4*b*, with the application of a predetermined amount of pressure from an unillustrated pressing means.

The toner charging roller 4*e* rotates following the rotation of the development roller 4*b*, or is independently rotated in the same direction as, and at the same peripheral surface velocity, as those of the development roller 4*b*.

The toner charging roller 4*e* in this embodiment is a rubber roller (elastic roller) with a diameter of 7 mm, and the contact pressure measured at the peripheral surface of the development roller 4*b* is in a range of $0.98\times10^{-2}$–$1.98\times10^{-2}$ N (100–200 gF).

To this toner charging roller 4*e*, a predetermined DC bias, the voltage level of which is higher than the voltage level at which the toner on the development roller 4*b* begins to be charged through electrical discharge, and the polarity of which is the same as the charge polarity of the toner t, is applied from a bias application electric power source S4.

The toner t held in the developing means housing portion 4*a* is conveyed toward the elastic roller 4*c* as a stirring member 4*f* is rotationally driven in the clockwise direction indicated by an arrow mark D while the developing apparatus is driven for a developing operation. As the elastic roller 4*c* rotates in the counterclockwise direction indicated by an arrow mark C, a portion of the toner t adjacent to the elastic roller 4*c* is moved to the adjacencies of the development roller 4*b*, and is charged as it is subjected to the friction which occurs in the interface between the development roller 4*b* and elastic roller 4*c*, adhering thereby to the peripheral surface of the development roller 4*b*. Thereafter, as the development roller 4*b* rotates further in the counterclockwise direction indicated by the arrow mark B, the toner t on the development roller 4*b* is conveyed to the area in which it is subjected to the pressure applied by the elastic blade 4*d*. As a result, a thin layer of toner t is formed on the peripheral surface of the development roller 4*b*.

In this embodiment, the elastic blade 4*d* is set up so that the amount of electrical charge which the toner t gains falls within a proper range of −60–−20 $\mu$C/g; the amount of toner falls within a proper range of 0.4–1 mg/cm$^2$; and the toner layer thickness falls within a range of 10–20 $\mu$m.

The toner charging roller 4*e*, to which the aforementioned bias is applied, contributes to maintain the amount of the electrical charge held by the toner t at a higher level. Further, as the toner charging roller 4*e* makes contact with the toner layer on the development roller 4*b*, the toner layer is packed more precisely and uniformly.

After passing through the location at which the toner charging roller 4*e* is in contact with the development roller 4*b*, the toner layer on the development roller 4*b* is conveyed to the developing station b, as the development roller 4*b* rotates further. Then, as the development roller 4*b* rotates further, the toner which remains on the development roller 4*b* without being used for the development of the electrostatic latent image on the photosensitive drum 1, in the development station b, is conveyed back into the developing means housing portion 4*a*, in which the residual toner is stripped away from the development roller 4*b*, at the location where the development roller 4*b* is in contact with the elastic roller 4*c*. The portion of the development roller 4*b*, from which the residual toner has been stripped away, is supplied with a fresh supply of toner t, by the elastic roller 4*c*. The above described operational cycle is repeated.

The charging range of the toner charging roller 4*e*, in terms of the direction perpendicular to the rotational direction of the development roller 4*b*, is equal to, or wider than, the image formation range of the photosensitive drum 1, in terms of the direction perpendicular to the rotational direction of the photosensitive drum 1.

In other words, in order to maintain the amount of the electrical charge retained by toner t at the higher level, the toner charging roller 4*e* is desired to be placed in contact with the development roller 4*b*, across the entirety of the range correspondent to the image formation range of the photosensitive drum, or wider range, in terms of the longitudinal direction of the development roller 4*b*, so that toner t is sufficiently charged by electrical discharge, across the above described range. The positional relationship between the elastic blade 4*d* and toner charging roller 4*e*, in terms of their longitudinal direction, is desired to be set up to assure that the toner charging roller 4*e* covers the entire range across which the elastic blade 4*d* is in contact with the development roller 4*b*. In other words, it is desired that, in terms of the longitudinal direction of the development roller 4*b*, the length of the range across which the toner charging roller 4*e* is placed in contact with the development roller 4*b*, with the presence of toner t between them (more specifically the toner charging roller 4*e* is contacted to a layer of the toner carried on (contacted to) the development roller 4*b*), is greater than the length of the range across which the elastic blade 4*d* is placed in contact with the development roller 4*b*, with the presence of toner t between them.

Next, a toner charging method will be described.

Figure 3:
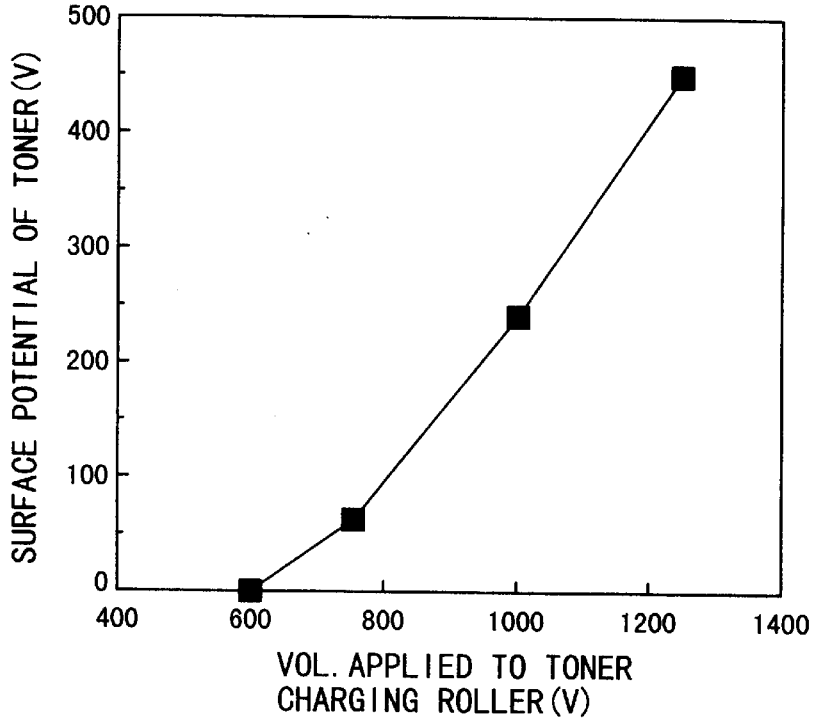
FIG. 3 is a graph which shows the characteristic of a toner charging roller with an electrical resistance of $10^8\Omega$, in terms of electrical discharge.

When the electrical resistance of the toner charging roller 4*e* is $10^8\Omega$, the relationship between the potential level of the voltage applied to the toner charging roller 4*e* and the level of the surface potential of toner becomes as shown in FIG. 3.

In other words, toner t has a surface potential level of −20 V even when the potential level of the voltage applied to the toner charging roller 4*e* is 0V. This is because toner t has been triboelectrically charged by the elastic blade 4*d*.

Ignoring the surface potential given by friction, the potential level at which electrical discharge begins between the toner charging roller 4*e* and toner t is −600 V, and the level of the surface potential of toner t increase at an inclination of 1, as shown in FIG. 3. In other words, the relationship between the potential level of the voltage applied to the toner charging roller 4*e* and the surface potential level of toner t is similar to the relationship between the surface potential level of the photosensitive drum 1 and the potential level of the DC voltage applied to the charge roller. The potential level at which electrical discharge begins between the toner charging roller 4*e* and toner t is obtained as the intersection between the following two formulas (1) and (2):

$$Vb=312+6.2\ g \quad (1)$$

$$Vg=g(Va-Vc)/\{(Lt/Kt)+g\} \quad (2)$$

Vb: approximation of Paschen's law (g>8 $\mu$m)

Vg: gap voltage between the surfaces of the toner charging roller 4*e* and toner layer surface Va: voltage applied to the toner charging roller 4*e*

Vc: surface potential level of the toner layer

Lt: toner layer thickness

Kt: relative dielectric constant.

The toner t used in this embodiment is superior in particle size distribution, and its particles are spherical. Therefore, the ratio of the amount of toner to the amount of air, in the toner layer, is constant; in other words, Kt in Formula (2) is stable, and therefore, the toner t is reliably charged by electrical discharge.

There is a charge injecting method as another method for charging toner t. When this charge injecting method was used, the relationship between the potential level of the voltage applied to the toner charging roller 4*e* and the surface potential level of toner t becomes as shown in FIG. 4.

Figure 4:
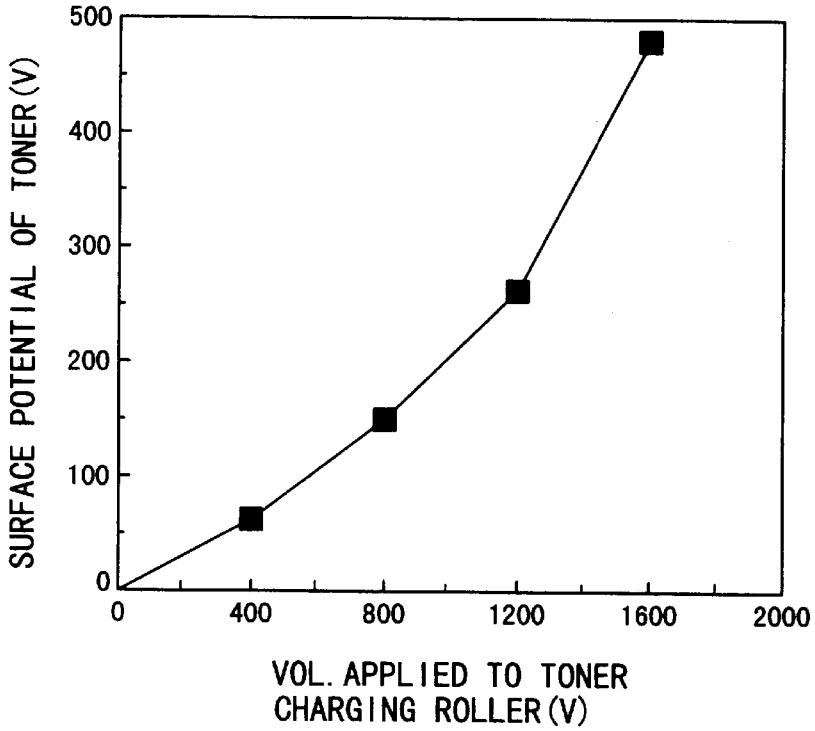
FIG. 4 is a graph which shows the relationship between the surface potential level of toner, and the level of the voltage applied to a toner charging roller, which occurs in charge injection.

Judging from the results shown in FIG. 4, it may be safe to think that toner t was charged through electrical discharge.

The above results correspond to a case in which the toner charging roller 4*e* was placed in contact with the toner coat portion, across the entire range in terms of the longitudinal direction of the charging roller 4*e*.

In addition, studies were made regarding the electrical resistance range in which toner t could be charged through electrical discharge. In the case of the structural arrangement in this embodiment, in which the bias for the toner charging roller 4*e* was obtained from the bias for the development bias, when the electrical resistance of the toner charging roller 4*e* was no more than $10^7\Omega$, no voltage was detected between the toner charging roller 4*e* and the toner coat portion chargeable by electrical discharge, whereas the electrical resistance of the toner charging roller 4*e* was no less than $10^{12}\Omega$, the potential level at which electrical discharge began was too high; in other words, an electrical resistance of $10^{12}\Omega$ or greater was not suitable.

Thus, the proper range for the electrical resistance of the toner charging roller 4*e* is $10^8\Omega$–$10^{11}\Omega$.

The method used for measuring the electrical resistance of the toner charging roller 4*e* was as follows. That is, an aluminum roller with a diameter of 30 mm was placed in contact with the toner charging roller 4*e*, across the entire range of the latter, so that a contact load of 1.67 N (170 gF) was obtained. Then, a resistance of 100 k$\Omega$ was connected to the ground side of the toner charging roller 4*e*. Then, −400 V was applied to the toner charging roller 4*e* while rotating the aluminum roller at 0.5 rps, and the voltage between the power source side of the resister and the ground side of the resister was measured. From the result of this measurement, the amount of current was calculated, and then, the electrical resistance of the toner charging roller 4*e* was calculated. The length was 220 mm.

Figure 5:
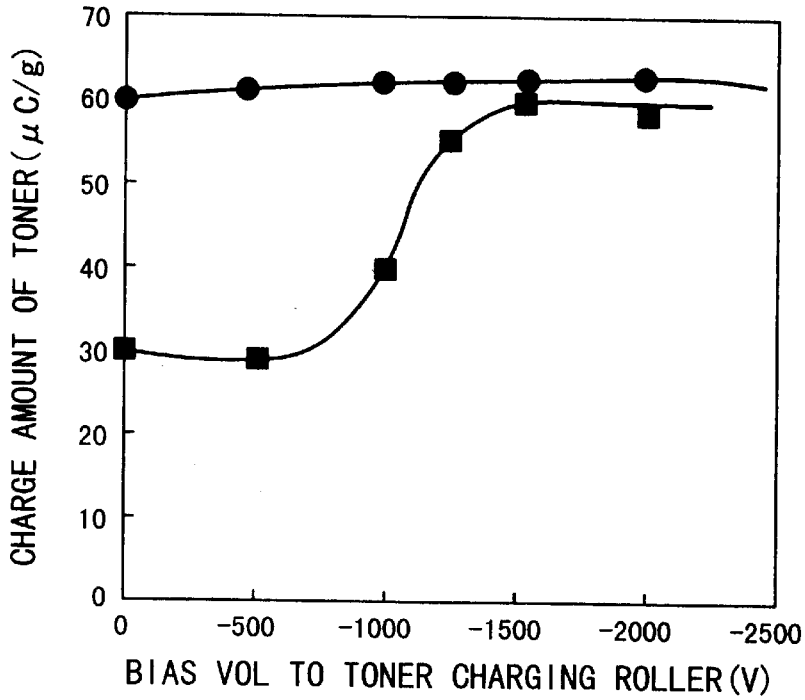
FIG. 5 is a graph which shows the relationship between the amount of the bias applied to the toner charging roller, and the amount of the electrical charge gained by the toner.

The relationship between the voltage between the toner charging roller 4*e* and development roller 4*b*, and the amount of the electrical charge obtained by the toner t on the development roller 4*b*, is shown in FIG. 5.

When the amount of the electrical charge held by the toner t after passing by the elastic blade 4*d* was −30 $\mu$C/g, application of no less than 1,200 V to the toner charging roller 4*e* caused the amount of the electrical charge held by the toner t to reach −60 $\mu$C/g, the saturation point. However, when the amount of the electrical charge held by the toner t after passing by the elastic blade 4*d* was −60 $\mu$C/g, the amount of the electrical charge held by the toner t remained stable at −60 $\mu$C/g, with no relation to the voltage applied to the toner charging roller 4*e*.

This means that, with the use of toner charging roller 4*e*, the amount of the electrical charge held by the toner t can be maintained at a high level even under such condition as high temperature-high humidity condition or low temperature-low humidity in which the amount of the electrical charge held by the toner t tends to change.

Figure 6:
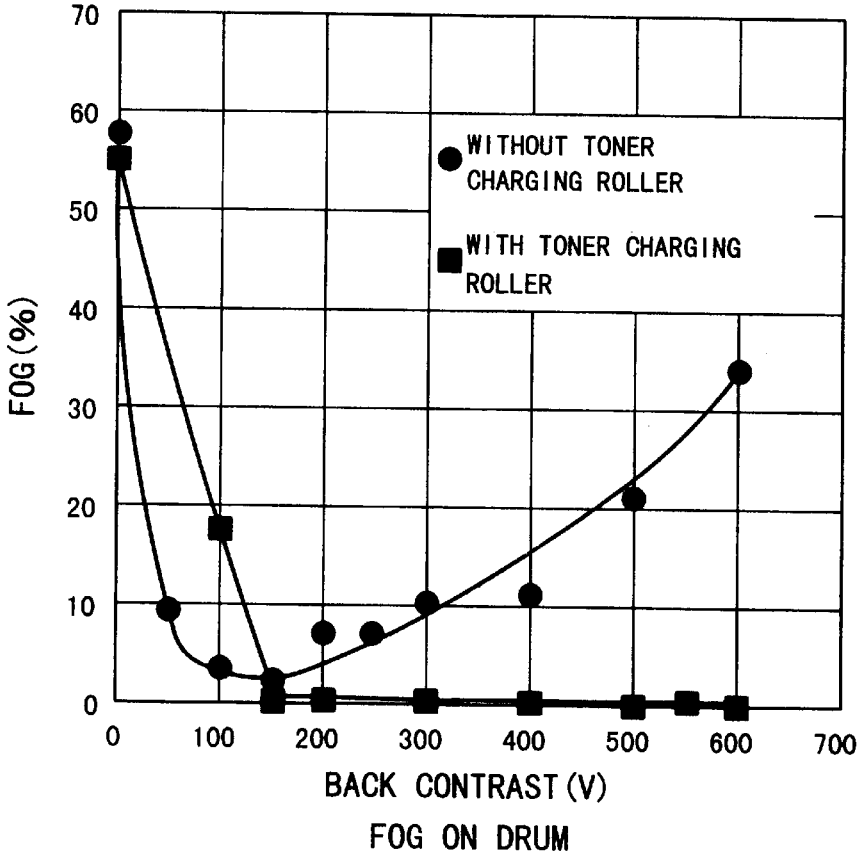
FIG. 6 is a graph which shows the relationship between the back contrast and fog.

FIG. 6 shows the effect of the toner charging roller 4*e* upon the reversal fog. As is evident from the graph, while the toner charging roller 4*e* was in use, no reversal fog occurred even when the back contrast (dark portion potential vs. development bias) was increased.

The method for measuring the amount of fog was as follows. First, the toner particles which transferred onto the photosensitive drum 1 and formed fog thereon were collected with the use of a piece of adhesive tape with transparent substrate. This piece of adhesive tape with the fog causing toner particles was pasted to a piece of white paper, along with a piece of unused adhesive tape as a reference piece, and the reflectance of both pieces of tape were measured. Then, the value of the reflectance of the sample tape was subtracted from the value of the reflectance of the referential tape, and the difference was used as "fog density". Reflectance was measured by TC-6DS (Tokyo Denshoku).

When the difference in potential level between the development roller 4*b* and toner charging roller 4*e* is 1,200 V, −300 V is applied to the development roller 4*b* from the electrical power source S2, and −1,500 V is applied to the toner charging roller 4*e* from the electrical power source S4, in order to secure development contrast. With this arrangement, the amount of the electrical charge held by each toner particle is unified at −60 $\mu$C/g by the toner charging roller 4*e*, and then, the toner particles are conveyed to the developing station b, in which they face the photosensitive drum 1. In the developing station b, the toner particles in the thin layer of toner formed on the development roller 4*b* are selectively transferred onto the photosensitive drum 1, in accordance with the electrostatic latent image on the photosensitive drum 1, by a DC voltage of −300 V applied to the development roller 4*b* from the power source S2. As a result, the electrostatic latent image is developed into a toner image, or an image formed of toner particles.

The residual toner particles, that is, the toner particles which are not consumed in the developing station b, are recovered from the bottom side of the development roller 4*b* as the development roller 4*b* rotates. More specifically, the residual toner particles are stripped away from the surface of the development roller 4*b*, in the interface between the elastic roller 4*c* and development roller 4*b*. Most of the stripped toner particles are moved within the developing means housing portion 4*a* by the rotation of the elastic roller 4*c*, and as they are moved, they mix with the toner t within the developing means housing portion 4*a*. As a result, the electrical charge held by each stripped residual toner particles is dispersed. At the same time as the residual toner particles are stripped, a fresh supply of toner is supplied to the peripheral surface of the development roller 4*b* by the rotation of the elastic roller 4*c*. Then, the above described process is repeated.

As described above, the provision of the toner charging roller 4*e* and the application of voltage with a potential level higher than the potential level at which toner begins to be electrically charged by electrical discharge, to the toner charging roller 4*e*, makes it possible to maintain the amount of the electrical charge held by the toner t at a high level, reducing thereby the amount of the reversal fog, increasing toner usage efficiency by a large margin, while producing images in which lines and dots are clearly defined.

In the first embodiment, the developing apparatus 4 was contained in the process cartridge 14 removably installable in the main assembly of an image forming apparatus. However, the developing apparatus 4 may be in the form of a developing apparatus, which is fixed to the image forming apparatus main assembly, and is replenished with toner when necessary, or may be in the form of a development cartridge (development unit), which contains only the developing apparatus 4, and is removably installable in the image forming apparatus main assembly.

Figure 7:
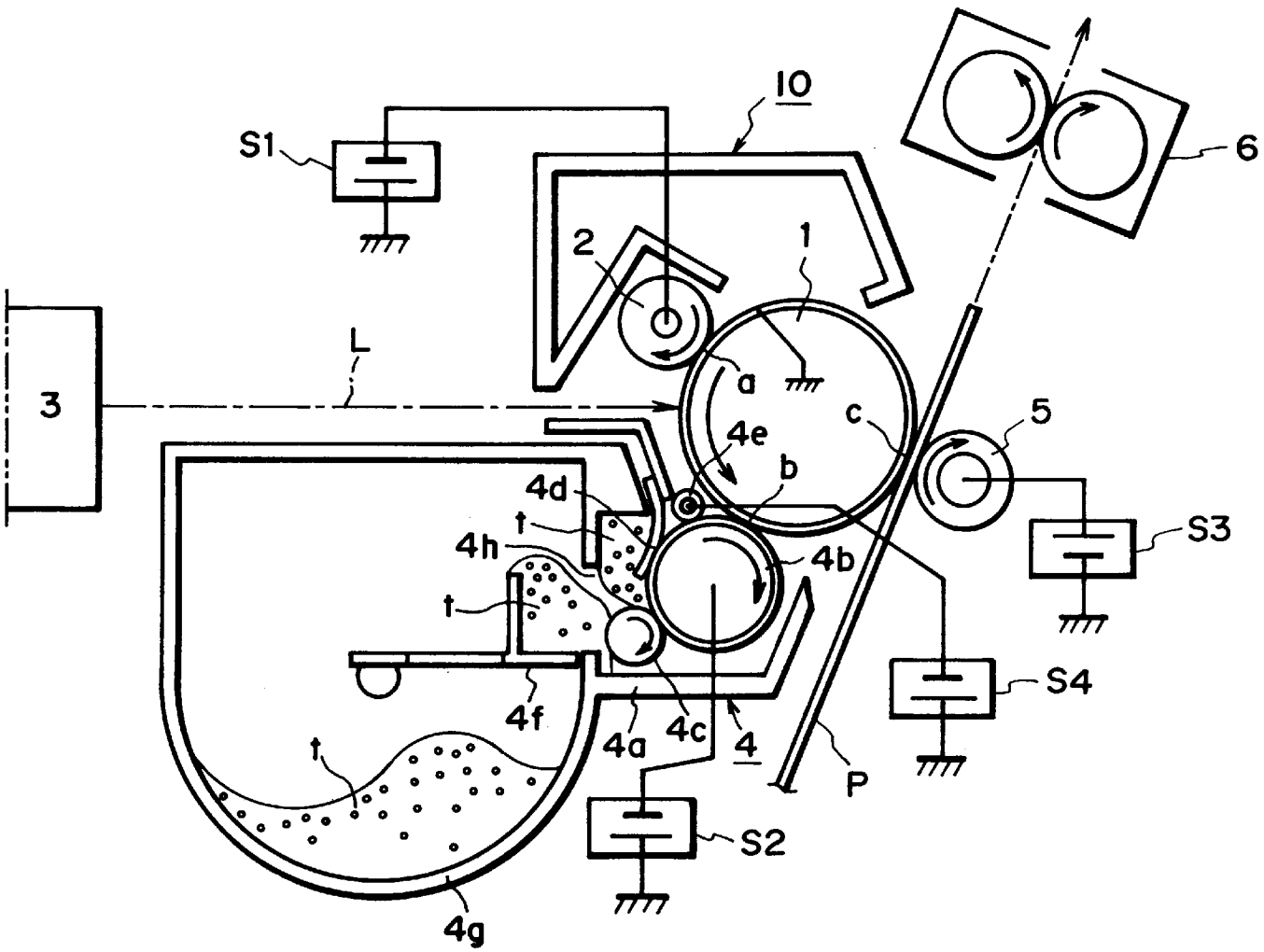
FIG. 7 is a schematic sectional view of the image forming apparatus in the second embodiment of the present invention, and depicts the general structure thereof.
Figure 8:
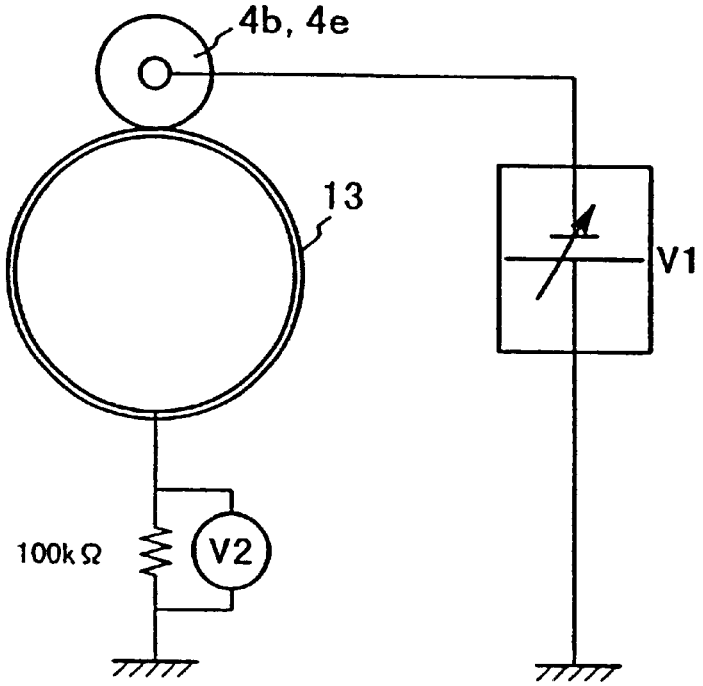
FIG. 8 is a schematic drawing which shows a method for measuring the electrical resistance of a roller.
Figure 9:
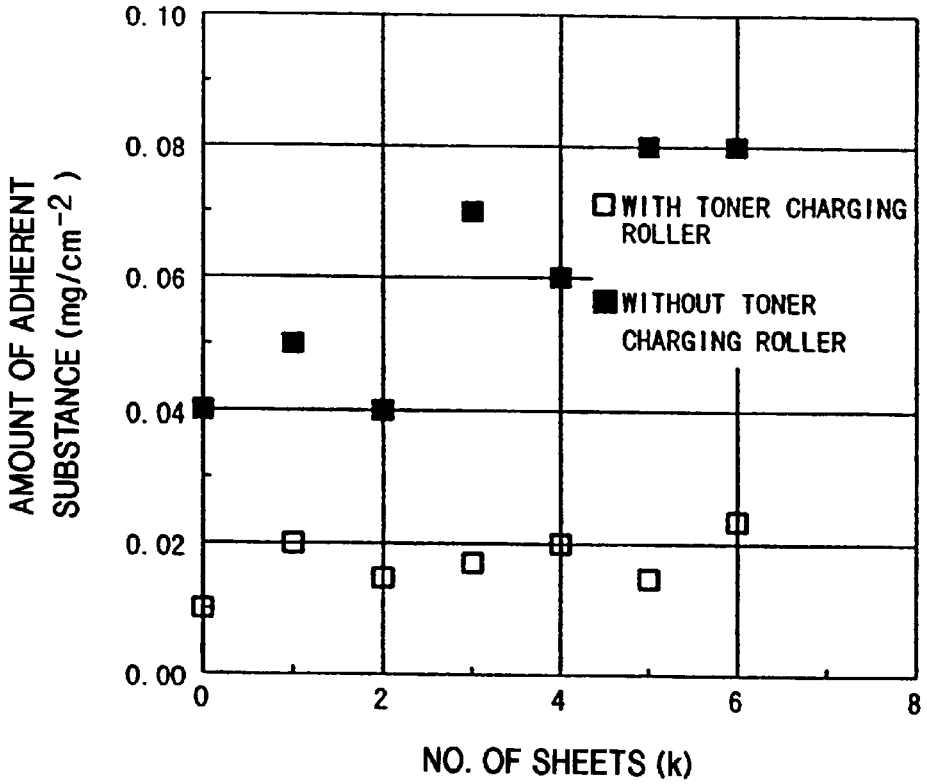
FIG. 9 is a graph which shows the relationship between the amount of adherent substance such as transfer residual toner, and the number of copies, which was varied from 0 to 6,000.

Embodiment 2 (FIGS. 7–9)

(1) Image Forming Apparatus

FIG. 7 is a schematic sectional view of the image forming apparatus in the second embodiment of the present invention, and depicts the general structure thereof. This image forming apparatus is a cleaner-less laser printer which uses an electrophotographic process, a transfer system, a reversal developing system, and a process cartridge system.

This laser printer in this embodiment is different from the printer in the first embodiment in that it is not equipped with a cleaning apparatus (7), in other words, it uses a cleaner-less process. Otherwise, the structure of this printer is approximately the same as that of the above described printer in the first embodiment.

The photosensitive drum 1 is rotationally driven in the counterclockwise direction indicated by an arrow mark at a process speed (peripheral velocity) of 94.2 mm/sec.

This photosensitive drum 1 is charged to predetermined polarity and potential level by the charge roller 2. In this embodiment, a DC voltage with a potential level equal to or greater than the potential level at which electrical discharge begins in the nip (charging station) between the charge roller 2 and photosensitive drum 1 is applied to the charge roller 2 from the charge bias application electrical power source S1. More specifically, a DC voltage of −300 V is applied as the charge bias to uniformly charge the peripheral surface of the photosensitive drum 1 to a potential level of −800 V (dark portion potential level).

The uniformly charged peripheral surface of the rotating photosensitive drum 1 is exposed using a scanning laser beam projected by a laser scanner 3. As a result, the potential level of the areas exposed to the laser beam L attenuates to −50 V. Consequently, an electrostatic latent image in accordance with the image formation data is formed on the peripheral surface of the photosensitive drum 1 by the electrostatic contrast between the exposed areas with a potential level of −50 V and the unexposed areas (dark areas) with a potential level of −800 V.

The electrostatic latent image formed on the peripheral surface of the photosensitive drum 1 is developed in reverse by negatively charged toner t (negative toner) as reversal developer, in the developing station b in the developing apparatus 4. In other words, the negative toner is adhered to the image portions (exposed portions) of the electrostatic latent image. This developing apparatus 4 will be described in more detail in the following section, i.e., Section 2.

The toner image on the peripheral surface of rotating photosensitive drum 1 is electrostatically transferred, continuously starting from the leading end, by the transfer roller 5, to which a predetermined transfer bias is being applied from the electrical power source S3, onto a piece of transfer medium P introduced into the transfer station c, that is, a contact nip between the photosensitive drum 1 and transfer roller 5, from an unillustrated sheet feeding portion, with proper timing.

After coming out of the transfer station c, the transfer medium P is separated from the peripheral surface of the photosensitive drum 1, continuously starting from the leading end, and introduced into a fixing apparatus 6, in which the toner image is fixed to the recording medium P. Then, the recording medium P is discharged as a copy.

After the transfer of the toner image onto the transfer medium P, the peripheral surface of the photosensitive drum 1 is used again for the following cycle of image formation. The printer in this embodiment is a cleaner-less printer, and therefore, the residual toner that is, the toner remaining on the peripheral surface of the photosensitive drum 1 after the image transfer, is conveyed to the developing station b through the charging station c, by the continual rotation of the photosensitive drum 1, and is recovered by the developing apparatus 4 at the same time as the latent image on the photosensitive drum 1 is developed by the developing apparatus 4. This process will be described later in detail, in Section 3.

A process cartridge 10 in this embodiment is in the form of a cartridge, which is removably installable in the main assembly of an image forming apparatus, and integrally comprises three processing devices: the photosensitive drum 1, charge roller 2 as a contact type charging member, and developing apparatus 4. It may be in the form of a cartridge which is removably installable in the image forming apparatus main assembly, and integrally comprises an image bearing member and at least one processing device among a charging means, a developing means, and the like. A process cartridge system makes it possible to give an image forming apparatus a user-friendly, that is, easy-to-handle, structure.

(2) Developing Apparatus 4

A referential character 4*a* designates a development roller housing portion, in which the development roller 4*b* as a developer bearing member, toner supplying roller 4*c* (elastic roller) for supplying the development roller 4*b* with toner, blade 4*d* for regulating the thickness of the toner layer, toner charging roller 4*e* as a developer charging means, and the like, are disposed. Designated by a referential character 4*g* is a toner hopper portion connected to the development roller housing portion 4*a*. A referential character 4*f* designates a toner stirring member disposed in this toner hopper portion 4*g*, and a referential character t designates negatively chargeable toner, as developer, held in the toner hopper portion 4*g*.

The negative toner t in the toner hopper portion 4*g* is stirred by the rotational movement of the toner stirring member 4*f*, and as it is stirred, a portion of it is supplied into the development roller housing portion 4*a* through a passage 4*h*.

The development roller 4*b* as a developer bearing member comprises a base layer formed of NBR, and a surface layer formed of ethyl urethane. Its surface roughness Rz is in a range of 5–10 $\mu$m, and its electrical resistance is in a range of $10^4$–$10^6\Omega$. This development roller 4*b* is placed in contact with the photosensitive drum 1, and is rotationally driven at a peripheral velocity of 170 mm/sec, which is faster than the process speed of the photosensitive drum 1, that is, 94.2 mm/sec, in such a direction that makes the peripheral surfaces of the development roller 4*b* and photosensitive drum 1 move in the same direction, in the interface between the two component. The interface between the development roller 4*b* and photosensitive drum 1 constitutes the developing station b.

A referential character combination S2 designates a development power source from which development bias is applied to the development roller 4*b*. In this embodiment, a development bias of −300 V is applied to the development roller 4*b* from the development power source S2.

The toner supplying roller 4*c* is formed of foamed urethane, and is disposed in contact with the development roller 4*b*, on the side almost directly opposite to the development station b across the development roller 4*b*. This toner supplying roller 4*c* is rotationally driven in the direction counter to the rotational direction of the development roller 4*b*, at a peripheral velocity of 80 mm/sec. The peripheral surface of the development roller 4*b* is coated by the toner supplying roller 4*c*, with the toner t in the development roller housing portion 4*a*.

The toner layer thickness regulating blade 4*d* is a doctoring blade (elastic blade) formed of urethane rubber or the like, and is attached to the development roller housing portion 4*a* by its base portion. It is placed in contact with the development roller 4*b*, surface to surface, at a location which is on the downstream side of the toner supplying roller 4*c* in terms of the rotational direction of the development roller 4*b*, and on the upstream side of the developing station in terms of the rotational direction of the development roller 4*b*, extending in the direction counter to the rotational direction of the development roller 4*b*.

The toner layer supplied to, and coated onto, the peripheral surface of the development roller 4*b* by the toner supplying roller 4*c* is regulated by this toner layer thickness regulating blade 4*d* so that its thickness becomes virtually uniform within a range of 0.4–0.6 mg/cm$^2$.

The toner charging roller 4*e* as a developer charging means has only a single layer of NBR. It surface roughness Rz is in a range of 5–10 $\mu$m, and its electrical resistance is in a range of $10^8$–$10^{11}\Omega$. This toner charging roller 4*e* is disposed in contact with the development roller 4*b*, at a location which is on the downstream side of the interface between the toner layer thickness regulating blade 4*d* and development roller 4*b* in terms of the rotational direction of the development roller 4*b*, and on the upstream side of the developing station b in terms of the rotational direction of the development roller 4*b*, and is rotated by the rotation of the development roller 4*b*.

A referential character combination S4 designates a toner charging electrical power source for applying toner charging bias to the toner charging roller 4*e* as a developer charging means.

To the toner charging roller 4*e*, bias, the potential level of which is higher than the potential level at which electrical discharge begins between the toner charging roller 4*e* and the toner on the development roller 4*b*, and the polarity of which is the same as that of the polarity to which the toner is to be charged, is applied. More specifically, in this embodiment, a DC voltage of 1,500 V is applied to the toner charging roller 4*e* from the toner charging electrical power source S4.

The method for measuring the electrical resistance of the development roller 4*b* and toner charging roller 4*e* is as follows. Referring to FIG. 8, an aluminum roller with a diameter of 30 mm is placed in contact with the roller 4*b* or 4*e*, so that the contact load becomes 1.67 N(170 gF), and a 100 k$\Omega$ resistor is to the ground side of the roller 4*b* or 4*e*. Then, a DC voltage of −400 V is applied from the electrical power source S1 to the roller 4*b* or 4*e* while rotating the aluminum roller 13 at 0.5 rps, and the voltage V2 between the two terminals of the resistor is measured to calculate the amount of current, from which the resistance of the roller 4*b* or 4*e* is calculated. The electrical resistance values of the rollers 4*b* and 4*e* obtained in this embodiment pertain to 220 mm in the longitudinal direction of the rollers.

As described above, the negative toner t in the toner hopper portion 4*g* is stirred by the rotational movement of the stirring member 4*f*, and as it is stirred, a portion of the negative toner t is supplied into the development roller housing portion 4*a* through the passage 4*h*. Then, the portion of the negative toner t in the development roller housing portion 4*a* is supplied to, and coated onto, the peripheral surface of the rotating development roller 4*b*, by the toner supplying roller 4*c*, and the coated portion of the negative toner t is regulated by the toner layer thickness regulating blade 4*d* so that it forms a toner layer with a predetermined thickness. Primarily, the negative toner t is electrically charged to the negative polarity by the friction which occurs as the toner t is stirred in the toner hopper portion 4*g*, the friction which occurs as the toner t is supplied to, and coated onto, the development roller 4*b* by the toner supplying roller 4*c*, and the friction which occurs as the thickness of the toner layer is regulated by the toner layer thickness regulating blade 4*d*.

In the case of this embodiment, however, a DC voltage of −1,500 V is applied to the toner charging roller 4*e* to force, through electrical discharge, an additional amount of electrical charge upon the toner t on the development roller, after the toner layer thickness is regulated by the toner layer thickness regulating blade 4*d*. After the forceful additional charging of the toner t, the amount of electrical charge held by the toner is in a range of −60–−40 $\mu$C/g.

The toner on the development roller 4*b*, which has been fully charged to the negative polarity, is carried to the developing station b by the further rotation of the development roller 4*b*. Then, in the developing station b, the fully charged toner transfers onto the peripheral surface of the photosensitive drum 1, across the exposed areas, that is, the image portions of the electrostatic latent image, and adheres thereto. In other words, the electrostatic latent image is developed in reverse.

The toner t as developer may be magnetic or nonmagnetic toner, and may be made by polymerization or pulverization. In this embodiment, spherical polymer toner, which is superior in transferability, and the shape factors SF-1 and SF-2 of which are in a range of 100–180 and a range of 100–140, respectively, is used.

The definitions of the shape factors SF-1 and SF-2, the method for forming the toner t, and the like, in this embodiment, are the same as those in the first embodiment.

(3) Simultaneous Developing-Cleaning Process (Cleaner-less Process)

The toner image on the peripheral surface of rotating photosensitive drum 1 is electrostatically transferred, continuously starting from the leading end, onto a piece of transfer medium P in the transfer station c. After the transfer of the toner image onto the transfer medium P, the peripheral surface of the photosensitive drum 1 is used again for the following cycle of image formation. The printer in this embodiment is a cleaner-less printer, and therefore, the residual toner, that is, the toner remaining on the peripheral surface of the photosensitive drum 1 after the image transfer, is conveyed to the developing station b through the charging station c, by the further rotation of the photosensitive drum 1, and is recovered by the developing apparatus 4 at the same time as the latent image on the photosensitive drum 1 is developed by the developing apparatus 4.

More specifically, after the image transfer, the peripheral surface of the photosensitive drum 1 is charged again by the charge roller 2 as it is passed through the charging station a by the further rotation of the photosensitive drum 1, with the adherent substance such as the residual toner still adhering thereto.

During this process of simultaneous developing and cleaning, among the toner particles in the residual toner, those which were reversed in polarity to positive by the transfer bias in the transfer station c, and those which failed to be sufficiently charged, adhered to the non-image areas (unexposed areas) of the electrostatic latent image, and thereby were reversed in polarity to positive, are reversed in polarity to negative by the charge roller 2.

Then, the peripheral surface of the photosensitive drum 1 is exposed to the scanning laser beam L modulated with the image formation data. As a result, an electrostatic latent image is formed on the peripheral surface of the photosensitive drum 1.

Next, in the developing station b, the adherent substance such as the residual toner particles present on the non-image areas of the electrostatic latent image on the peripheral surface of the photosensitive drum 1 is recovered from the peripheral surface of the photosensitive drum 1 into the developing apparatus 1 by the difference in electrical potential level between the development bias applied to the development roller 4*b*, and the electrical potential of the dark area, that is, the electrical potential of the non-image areas of the electrostatic latent image on the peripheral surface of the photosensitive drum 1, and at the same time, the image areas (exposed areas) of the electrostatic latent image are developed with the negative toner on the development roller 4*b* of the developing apparatus (simultaneous developing-cleaning process).

The transfer residual toner recovered from the non-image areas of the electrostatic latent image on the peripheral surface of the photosensitive drum 1 into the developing apparatus is reused, and therefore, no waste tone is produced.

However, this cleaner-less cleaning process carried out at the same time as the developing process is carried out has its own problem in that in order for the cleaner-less process to be efficiently carried out, control must be executed so that the amount of the adherent substance such as the transfer residual toner adhering to the peripheral surface of the photosensitive drum 1 must be no more than 0.03 mg/cm$^2$.

In this embodiment, this problem is solved by forcefully and sufficiently charging the toner, to the polarity necessary to developing the latent image, that is, the negative polarity in this embodiment, with the use of the toner charging roller 4*e* to which voltage is being applied, while the toner is carried to the developing station a, being borne by the development roller 2. With this arrangement, the amount of the toner which failed to be sufficiently charged, and adhered to the non-image areas (unexposed areas) of the electrostatic latent image during the developing process, that is, the toner, the polarity of which was reversed to positive, can be significantly reduced; in other words, the total amount of the adherent substance such as the transfer residual toner which adheres to the peripheral surface of the photosensitive drum 1 can be reduced to no more than 0.03 mg/cm$^2$.

Further, using spherical toner, which is superior in transferability as described above, as the toner t, makes it possible to reduce the amount of the residual toner itself which remains on the peripheral surface of the photosensitive drum 1 after the toner image formed through the development of the image areas (exposed areas) of the electrostatic latent image is transferred onto the transfer medium P. This usage of spherical toner, and the aforementioned forceful, full charging of the toner by the toner charging roller 4*e*, have synergetic effect in reducing the total amount of the transfer residual toner, and the other debris, which remain on the peripheral surface photosensitive drum 1 after the image transfer, to no more than 0.03 mg/cm$^2$. In addition, they are effective to stabilize the state in which the toner particles are packed in the toner layer, so that it is assured that the toner is fully charged through electrical discharged to reduce the amount of the reversely charged toner.

FIG. 9 is a graph which shows the difference in the amount of the adherent substance such as the transfer residual toner which adhered to the photosensitive drum 1, between when the toner charging roller 4*e* was employed, and when not, through the production of 6,000 copies.

It is evident from the graph that when the toner charging roller 4*e* was not present, the amount of the debris such as the transfer residual toner exceeded 0.03 mg/cm$^2$.

With the provision of the toner charging roller 4*e*, the amount of the adherent substance such as the transfer residual toner which adheres to the photosensitive drum 1 decreases. As a result, the period in which the photosensitive drum 1 is properly charged extends; the adherent substance such as the transfer residual toner is efficiently recovered by the developing apparatus 4 and reused, increasing toner usage efficiency by a large margin; and therefore, superior image quality is realized.

In this embodiment, the toner charging roller 4*e* with which the developing apparatus 4 is provided is made longer than the charge roller 2 for charging the photosensitive drum 1, to reduce the amount of the reversal toner on the photosensitive drum charging roller 2, across the entire range in the longitudinal direction of the photosensitive drum 1.

Miscellanies

1) The charge roller 2 as a contact type charging member may be rotationally driven in the same direction as, or in the direction opposite to, the photosensitive drum 1 as an image bearing member. The configuration of the contact type charging member is optional: it may be in the form of a fur brush, a magnetic brush roller, a blade, or the like.

It is not mandatory that the charging member is disposed in contact with the surface of the image bearing member, with the application of a predetermined amount of pressure. That is, the charging member may be disposed close enough to trigger electrical discharge between the peripheral surfaces of the photosensitive drum 1 and charge roller 2 so that the photosensitive drum 1 is charged by the electrical discharge. Whether or not electrical discharge occurs across the gap between the photosensitive drum 1 and charge roller 2 is determined by the voltage across the gap and Paschen's curve. The present invention is also compatible with such an arrangement.

It is not mandatory that the image bearing member is charged by charge injection. When electrical charge is injected into the image bearing member, the image bearing member is desired to have a surface layer, the surface electrical resistance of which is in a range of $10^9$–$10^{14}$ Ω·cm. As for the image bearing member, it is possible to use a photosensitive member chargeable through charge injection; for example, an OCL type photosensitive member with a coated surface layer (charge injectable layer) in which electrically conductive particles such as $SnO_2$ particles are dispersed, or a photosensitive member with a surface layer formed of α-Si (amorphous silicon, or noncrystalline silicon).

2) When adding AC voltage (alternating voltage) to the bias applied to the contact type charging member 2 or developer bearing member 4*b*, the waveform of the AC voltage is optional: it may be sinusoidal, rectangular, triangular, or the like; it may be in the form of a rectangular wave formed by periodically turning on and off a DC power source. In other words, any alternative voltage may be used as long as its voltage level periodically change.

3) The means for exposing the photosensitive drum 1 to form an electrostatic latent image does not need to be limited to an exposing means based on a scanning laser beam, such as the one used in this embodiment, which digitally forms a latent image; it may be an analog exposing means, for example, a light emitting element such as an LED, or a combination of a light emitting element, such as a fluorescent light, and a liquid crystal shutter. In other words, any exposing means will do as long as it can form an electrostatic latent image in accordance with the image formation data.

4) The image bearing member may be an electrostatically recordable dielectric member. In such a case, the surface of the dielectric member is uniformly charged (primary charge) to the predetermined polarity and potential level, and the electrical charge is removed from the selected areas of the uniformly charge peripheral surface of the dielectric member by a charge removing means, such as charging removing needle head or an electron gun, to write an intended electrostatic latent image on the peripheral surface of the photosensitive drum 1.

5) The developer charging means for charging the developer which is borne on the developer bearing member and conveyed to the developing station, to the polarity suitable for developing an electrostatic latent image, at a location on the upstream side of the developing station, in terms of the developer conveyance direction of the developer bearing member, may be a corona type charging device.

6) The choice of the transferring means 5 to which the present invention is applied does not need to be limited to a roller type means; it is optional. For example, the present invention is also applicable to a belt based transferring means or a corona discharging type transferring means. Also, the present invention is applicable to not only a monochromatic image forming apparatus, but also an image forming apparatus which is capable of forming a multicolor image or a full-color image, with the use of a multiple transfer process or the like.

7) One example of a method for measuring the toner particle size is as follows. As for the measuring apparatuses, a Coulter counter TA-2 (product of Coulter Co., Ltd.) is used, which is connected to an interface (product of Nikkaki Co., Ltd.) for outputting number average distribution and volumetric average distribution, and also to a personal computer CX-1 (product of Canon Inc.). The electrolyte is 1% water solution of first class sodium chloride.

As for the actual measuring method, 0.1–5 ml of surfactant, preferably, alkyl benzene sulfonate, is added as dispersant to the aforementioned electrolyte, and then, 0.5–50 mg of sample is added.

Next, the electrolyte in which the sample is suspended is subjected to a dispersing process for approximately 1–3 minutes with the use of a supersonic dispersing device. Then, the particle size distribution of the particles with a particle size in a range of 2–40 μm is obtained using the aforementioned Coulter counter TA-2 fitted with a 100 μm aperture, and the volumetric average distribution is obtained. Then, the volumetric average diameter of the sample is obtained from the volumetric average distribution.

As described above, according to this embodiment, reversal fog, that is, a problem in a contact type developing process which uses single component nonmagnetic developer and DC voltage, is reduced. As a result, the amount of toner consumption is reduced; the service life of a developing apparatus is increased; the cost for running an image forming apparatus is reduced; and the electrical charge held by toner is kept at a proper level for producing sharp lines and dots, that is, lines and dots which do not suffer from the smudged appearance resulting from scattered toner particles.

Also according to this embodiment, in an image forming apparatus which employs a cleaner-less process, the total amount of the transfer residual toner and other debris, which remain adhered to the peripheral surface of the image bearing member after image transfer, is substantially reduced by reducing the amount of reversal toner (reversal fog), that is, the toner which fails to be sufficiently charged and adheres to the non-image areas of an electrostatic latent image during development, and which amounts to the major portion of the transfer residual toner and other debris which remains adhered to the peripheral surface of the image bearing member. Therefore, a charging member is prevented from being contaminated by adherent substance such as the transfer residual toner. Thus, it is possible to extend the length of the period in which it is assured that the image bearing member, and the transfer residual toner and other debris, are sufficiently charged, is substantially extended.

Further, according to the present invention, the charging member is not contaminated with adherent substance such as the transfer residual toner, across the entire charging range of the charging member.

Therefore, it is possible to extend the period in which it is assured that the image bearing member and the adherent substance such as the transfer residual toner are sufficiently charged.

Further, according to the present invention, the state in which the toner particles in the developer layer on the developer bearing member of the developing means are packed, is stabilized, assuring that the toner particles are sufficiently charged through electrical discharge, and also, it is possible to improve the structure of an image forming apparatus in terms of user friendliness.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

an image bearing member;

charging means for electrically charging said image bearing member;

electrostatic image forming means for forming an electrostatic image on said image bearing member charged by said charging means;

a developing and cleaning member for developing the electrostatic image on said image bearing member and removing residual toner from said image bearing member;

a regulating member for regulating an amount of toner on said developing and cleaning member and for triboelectrically charging the toner;

electric charge application means for applying electric charge of a regular polarity to the toner on said developing and cleaning member, said electric charge application means being disposed upstream of a developing portion and a cleaning portion of and downstream of a regulating portion of said regulating means with respect to a movement direction of said developing and cleaning member.

2. An apparatus according to claim 1, wherein said electric charge application means applies a discharging charge to the toner.

3. An apparatus according to claim 1, wherein said developing and cleaning member is press-contacted to said image bearing member.

4. An apparatus according to claim 1, wherein said charge application means is contacted to and is driven to said developing and cleaning member.

5. An apparatus according to claim 1, wherein the toner has shape factors SF-1 in the range of 100–180 and SF-2 in the range of 100–140.

6. An apparatus according to claim 1, wherein an amount of the toner remaining on said image bearing member after toner is removed from said image bearing member by said developing and cleaning member is not larger than 0.03 $mg/cm^2$.

* * * * *

UNITED STATES PATENT AND TRADEMARK OFFICE

CERTIFICATE OF CORRECTION

PATENT NO. : 6,314,257 B1
DATED : November 6, 2001
INVENTOR(S) : Yasuyuki Ishii et al.

It is certified that error appears in the above-identified patent and that said Letters Patent is hereby corrected as shown below:

Column 2,
Line 39, "operational," should read -- operational --; and
Line 40, "cycle" should read -- cycle, --.

Column 3,
Line 15, "turns" should read -- turn --.

Column 5,
Line 1, "charge" should read -- charged --;
Line 7, "signals" should read -- signal --; and
Line 15, "charge" should read -- charged --.

Column 7,
Line 4, "N, 500 gf)" should read -- N (500 gf) --.

Column 15,
Line 12, "component." should read -- components. --; and
Line 47, "It" should read -- Its --.

Column 18,
Line 22, "discharged" should read -- discharge --.

UNITED STATES PATENT AND TRADEMARK OFFICE

CERTIFICATE OF CORRECTION

PATENT NO. : 6,314,257 B1
DATED : November 6, 2001
INVENTOR(S) : Yasuyuki Ishii et al.

It is certified that error appears in the above-identified patent and that said Letters Patent is hereby corrected as shown below:

Column 19,
Line 19, "change." should read -- changes. --;
Line 36, "charge" should read -- charged --; and
Line 37, "charging" should read -- a charging --.

Signed and Sealed this

Ninth Day of April, 2002

*Attest:*

*Attesting Officer*

JAMES E. ROGAN
*Director of the United States Patent and Trademark Office*